US009795818B2

(12) United States Patent
Powell

(10) Patent No.: US 9,795,818 B2
(45) Date of Patent: Oct. 24, 2017

(54) EXERCISE DEVICE AND METHOD OF USE

(76) Inventor: Stewart William Powell, Eltham Victoria (AU)

( * ) Notice: Subject to any disclaimer, the term of this patent is extended or adjusted under 35 U.S.C. 154(b) by 41 days.

(21) Appl. No.: 14/241,988

(22) PCT Filed: Aug. 31, 2012

(86) PCT No.: PCT/AU2012/001021
§ 371 (c)(1),
(2), (4) Date: Feb. 28, 2014

(87) PCT Pub. No.: WO2013/033757
PCT Pub. Date: Mar. 14, 2013

(65) Prior Publication Data

US 2014/0228181 A1 Aug. 14, 2014

(30) Foreign Application Priority Data

Sep. 5, 2011 (AU) ..... 2011903576

(51) Int. Cl.

| | |
|---|---|
| ***A63B 21/00*** | (2006.01) |
| ***A63B 21/015*** | (2006.01) |
| ***A63B 21/04*** | (2006.01) |
| ***A63B 21/055*** | (2006.01) |
| ***A63B 23/035*** | (2006.01) |
| ***A63B 71/02*** | (2006.01) |

(52) U.S. Cl.

CPC ..... *A63B 21/015* (2013.01); *A63B 21/00069* (2013.01); *A63B 21/0442* (2013.01); *A63B 21/0552* (2013.01); *A63B 23/03541* (2013.01); *A63B 21/4011* (2015.10); *A63B 21/4015* (2015.10); *A63B 21/4017* (2015.10); *A63B 2071/027* (2013.01); *A63B 2208/0204* (2013.01); *A63B 2208/0214* (2013.01); *A63B 2208/0228* (2013.01); *A63B 2208/0242* (2013.01); *A63B 2209/10* (2013.01)

(58) Field of Classification Search
CPC combination set(s) only.
See application file for complete search history.

(56) References Cited

U.S. PATENT DOCUMENTS 5,147,264 A * 9/1992 Braathen ..... A63B 21/015 482/118
5,813,953 A * 9/1998 Whipple ..... A63B 21/169 482/123
6,500,105 B1 12/2002 Kuo
(Continued)

OTHER PUBLICATIONS

International Preliminary Report on Patentability dated Mar. 20, 2014, issued by the International Searching Authority in corresponding International Application No. PCT/AU2012/001021.
(Continued)

*Primary Examiner* — Sundhara Ganesan
*Assistant Examiner* — Jennifer M Deichl
(74) *Attorney, Agent, or Firm* — Sughrue Mion, PLLC

(57) ABSTRACT

An exercise device comprising; a platform, a first limb attachment means, a first extendable cord attached to the first limb attachment means, the first extendable cord being at least partially located within the platform, and a tensioning means within the platform, wherein the tensioning means can be adjusted to alter the resistance of the first extendable cord to extension.

12 Claims, 5 Drawing Sheets

(56) References Cited

U.S. PATENT DOCUMENTS

| | | | | |
|---|---|---|---|---|
| 7,250,021 | B2 * | 7/2007 | Leight | A63B 21/025 482/116 |
| 7,524,272 | B2 * | 4/2009 | Bruck | A63B 21/153 482/126 |
| 7,591,763 | B1 * | 9/2009 | Fucci | A63B 21/4029 482/121 |
| 7,601,105 | B1 * | 10/2009 | Gipson, III | A63B 21/055 482/103 |
| 7,601,107 | B2 | 10/2009 | Maloy et al. | |
| 7,637,855 | B2 | 12/2009 | Bizzell et al. | |
| 7,942,793 | B2 * | 5/2011 | Mills et al. | 482/130 |
| 2003/0153441 | A1 | 8/2003 | Berns et al. | |

OTHER PUBLICATIONS

International Search Report of PCT/AU2012/001021 dated Oct. 15, 2012.

* cited by examiner

EXERCISE DEVICE AND METHOD OF USE

CROSS REFERENCE TO RELATED APPLICATION

The is a National Stage of International Application No. PCT/AU2012/001021 filed Aug. 31, 2012, claiming priority based on Australian Patent Application No. 2011903576 filed Sep. 5, 2011, the contents of all of which are incorporated herein by reference in their entirety.

FIELD OF INVENTION

The present invention relates to the field of exercising devices. More specifically the present invention relates to a simple, inexpensive physical exerciser for exercising the muscles of the limbs and/or body.

In one particular aspect the present invention is suitable for use as a portable exercising device suitable for home or gymnasium use for a range of exercise applications including fitness training and patient rehabilitation.

It will be convenient to hereinafter describe the invention in relation to stretching exercises, however it should be appreciated that the present invention is not limited to that use and can be used for a range of different exercises.

BACKGROUND ART

Throughout this specification the use of the word "inventor" in singular form may be taken as reference to one (singular) inventor or more than one (plural) inventor of the present invention.

It is to be appreciated that any discussion of documents, devices, acts or knowledge in this specification is included to explain the context of the present invention. Further, the discussion throughout this specification comes about due to the realisation of the inventor and/or the identification of certain related art problems by the inventor. Moreover, any discussion of material such as documents, devices, acts, or knowledge in this specification is included to explain the context of the invention in terms of the inventor's knowledge and experience and, accordingly, any such discussion should not be taken as an admission that any of the material forms part of the prior art base or the common general knowledge in the relevant art in Australia, or elsewhere, on or before the priority date of the disclosure and claims herein.

Many different physical exercising devices are available for exercising different groups of muscles or parts of the body. These physical exercising devices are typically heavy, complicated and expensive. They are also often designed for one specific purpose, such as training the muscles of a specific part of the body. For example, gymnasiums often have a range of fixed weight exercise machines, each designed to exercise one specific muscle group. However, it is often inconvenient or expensive to repeatedly visit a gymnasium. Those who commit to a gymnasium subscription and regularly use the exercise machines usually have to break their routine when they travel and/or go on vacation.

Efforts made to overcome these problems has led to development of an enormous range of handy exercising apparatus including chest expanders, hand muscle developers etc. However most of these are only used for a specific part of the body and/or allow for only one method of training. For example a conventional chest expander for developing the muscles of the chest generally comprises two handles and a plurality of elastic cord members connected between the handles. While this, type of apparatus is inexpensive, its use over a long period of time is boring because it provides only one single function.

U.S. Pat. No. 6,500,105 describes an exercising apparatus having a number of components which, along with the carry bag, can be assembled in different conformations. Each conformation allows the chest muscles to the exercised in a different manner. However it only exercises one group of muscles (chest) and is complicated to assemble and disassemble.

U.S. Pat. No. 7,601,107 discloses an exercise device for exercising multiple muscle groups without the need for complicated integrating parts. In particular it includes a platform on which a user can stand, the platform allowing a free range of motion about a vertical axis without substantial resistance. Thus the user carry out exercises that include rotating, pivoting, rolling or rocking motion. Resistance bands of various strengths can be inserted into various slots on the platform for pulling exercises.

U.S. Pat. No. 7,637,855 describes a similar type of device including a platform for use in exercises in an unstable configuration. The platform includes a stepping deck for the user, an arched base for rocking support of the stepping deck and a plurality of resistance bands housed within the platform.

SUMMARY OF INVENTION

An object of the present invention is to provide a pulling exerciser which is light and portable and can be conveniently adjusted to provide different resistance force to suit different exercise requirements.

Another object of the present invention is to provide an exerciser that can be readily adjusted to different degrees of resistance.

It is still another object of the present invention to provide a versatile exercising machine which can be used for exercising the muscles of the chest, back, abdomen, the upper extremity or the lower extremity.

Another object of the present invention is to provide a pulling exerciser that can be used for pulling with the hands or legs in a variety of postures to exercise groups of muscles.

A further object of the present invention is to alleviate at least one disadvantage associated with the related art.

It is an object of the embodiments described herein to overcome or alleviate at least one of the above noted drawbacks of related art systems or to at least provide a useful alternative to related art systems.

In a first aspect of embodiments described herein there is provided an exercise device comprising;

- a platform,
- a first limb attachment means,
- a first extendable cord attached to the first limb attachment means, the extendable cord being at least partially located within the platform, and

- a tensioning means within the platform, wherein the tensioning means can be adjusted to alter the resistance of the first extendable cord to extension.

The exercise device may additionally comprise a second limb attachment means, the first extendable cord being intermediate the first and second limb attachment means. Alternatively, the second limb attachment means may be attached to a second extendable cord that is at least partially located within the platform.

In another aspect of embodiments described herein there is provided an exercise device, wherein the extendable cord is attached to the tensioning means and rotation of the tensioning means alters the resistance to extension of the cord.

The platform is configured to rest on a workout surface. The platform typically comprises a housing having an upper surface which is large enough for the user to stand, step, sit, kneel or lie upon. The upper surface will typically include resilient characteristics or be cushioned to reduce the impact experienced by the part of the user's body that contacts the platform. The housing may have sides and optionally a lower surface that includes a non-slip coating to resist movement against the workout surface. The platform may be manufactured of any convenient material, preferably a material that is relatively inflexible and durable. This would include, for example wood, polymers metals and combinations thereof.

The extendable cord may be any convenient material that can be stretched longitudinally. Many different types of extendable cord are known to those skilled in the art including resistance tubing marketed under the trade marks EVERLAST PLATES™ resistance tubing, VERSATUBE™, XERTUBE™ and THERABAND™. Alternatively the extendable cord may be in the form of an elongate coil spring, or a composite of resistance tubing and a coil spring. Typically either end of the extendable cord extends from either side of the platform.

The limb attachment means are at either end of the extendable cord and may be removable. For example they may each include a carabineer for attachment to the cord. The limb attachment means may take any convenient conformation, such as handles for manual use or loops or straps (such as VELCRO™ straps) for attachment to the feet, legs, thighs, forearms or upper arms.

The one or more extendable cords are at least partially located within the platform, connected to the tensioning means. Typically the tensioning means comprises a disk and hub that can be manually rotated. In one embodiment of the present invention the disk and hub interconnect with a biasing means, such as a planar, circular spring. The extendable cord(s) are connected to the disk or hub such that rotation of the disk in one direction reduces the length of cord extending from the platform, while rotation in the opposite direction increases the length of cord extending from the platform. The extendable cord is effectively rolled and unrolled around the disk or hub, thus adjusting it to any convenient length. Reducing the length-of cord extending from the platform increases the resistance experience by the user and the degree of tension in the cord as the user pulls to extend it. Increasing the length of cord extending from the platform decreases the resistance experienced by the user and the degree of tension in the cord as the user pulls to extend it.

Typically the tensioning means is accessed by inverting the platform so that the disk can be directly grasped and manually rotated. Alternatively, in another embodiment the upper surface or side of the platform housing includes an actuator for the tensioning means. Typically the actuator is in the form of a foot pedal which is depressed to allow the disk to be manually rotated, for example, by pulling on the extendable cord.

The tensioning means also typically includes a retainer. For example the retainer may be a pin, latch or other convenient means for holding the disk in a particular position relative to the scale. The retainer for example, may be removably inserted into notches or recesses associated with the disc.

In a particularly preferred embodiment the tensioning means includes an indicator that reflects the extent of rotation of the disk and the amount of tension the user is likely to experience when they pull on the handles. Thus the user does not need to change the extendable cord to achieve different levels of resistance.

In a yet further aspect of embodiments described herein there is provided a method of exercising using the exercise device of the present invention including the steps comprising, (a) the user standing, sitting, kneeling or lying on the platform, (b) the user engaging one or both limb attachment means, and (c) the user applying pulling force to extend the extendable cord from the platform, then (d) releasing the pulling force to allow the first, extendable cord to retract into the platform under the influence of a biasing means. For example, when the limb attachment means are handles, the user may engage with the handles by manually grasping one or both. Alternatively, the limb attachment means may comprise Velcro straps that can be engaged by wrapping around a forearm, calf, hand or foot. The user may then move their limb in any appropriate direction to pull on the extendable cord and thus exercise or train the relevant muscle or muscle group.

Other aspects and preferred forms are disclosed in the specification and/or defined in the appended claims, forming a part of the description of the invention.

In essence, embodiments of the present invention stem from the realization that a variety of extendable cord resistance levels can be achieved for a single cord in an exercise device using a simple device to alter the cord length.

Advantages provided by the present invention comprise the following:

- a user can have a complete workout experience using a single device;
- the resistance can be easily adjusted to various resistance values without having to change components such as resistance bands;
- the device can be used for stretching, core strength training, balance training, cardiovascular exercise and general strength training;
- the device can be used for exercising muscles of the chest, back, abdomen, upper extremity or lower extremity;
- the device is lightweight and portable;
- the device is of simple construction and low cost to manufacture;
- the device can be readily stored in limited space such as an overhead aeroplane locker, sports bag or car boot;
- the device can be adjusted for users of any age, strength and skill level;
- the device is suitable for use at home or in a gymnasium.

Further scope of applicability of embodiments of the present invention will become apparent from the detailed description given hereinafter. However, it should be understood that the detailed description and specific examples, while indicating preferred embodiments of the invention, are given by way of illustration only, since various changes and modifications within the spirit and scope of the disclosure herein will become apparent to those skilled in the art from this detailed description.

BRIEF DESCRIPTION OF THE DRAWINGS

Further disclosure, objects, advantages and aspects of preferred and other embodiments of the present application may be better understood by those skilled in the relevant art by reference to the following description of embodiments taken in conjunction with the accompanying drawings, which are given by way of illustration only, and thus are not limitative of the disclosure herein, and in which.

and

Figure 4:
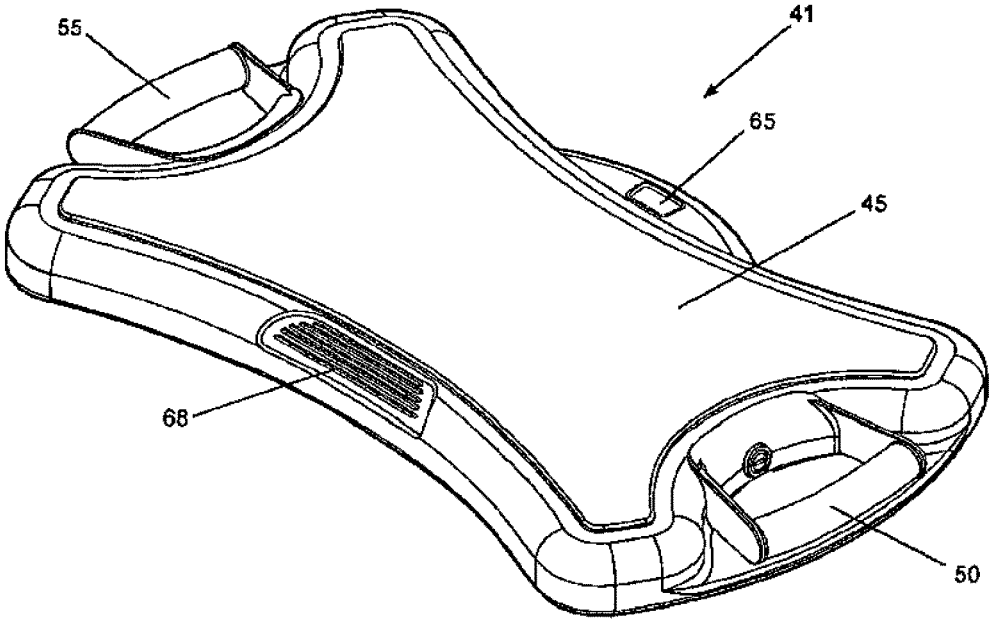
FIG. 4 illustrates another embodiment of an exercise device of the present invention.
Figure 5:
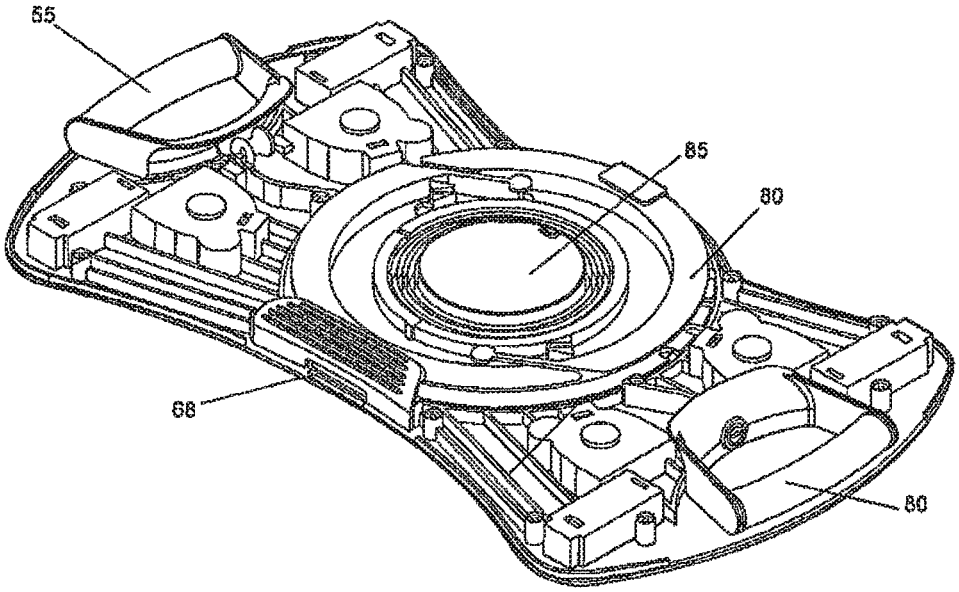

FIG. 5 illustrates the exercise device of FIG. 4 when inverted.

Figure 1:
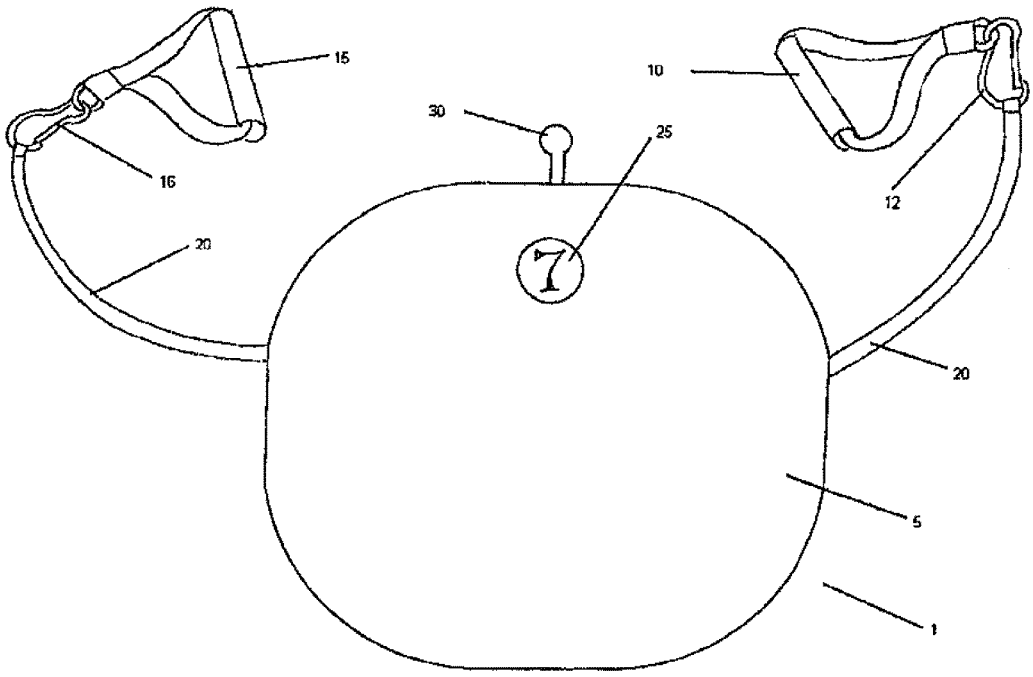
FIG. 1 illustrates one embodiment of an exercise device of the present invention.

FIG. 1 illustrates an exercise device (1) of the present invention viewed from the user perspective. In this view can be seen the upper surface of the platform (5) and a first handle (10) and a second handle (15) at either end of an extendable cord (20). The upper surface of the platform (5) in this embodiment is about 40×40 cm which is sufficient to receive both feet of a user. The platform (5) also has sides which are end on in this view, and about 8 cms high. The first and second handles (10,15) are attached to the extendable cord (20) by their respective carabineers (12, 16). The part of the extendable cord (20) that cannot be seen is located within the platform (5). The platform (5) includes a window (25) that can display numbers indicating the relative amount of tension a user is likely to experience when they pull, on one or both of the handles (10,15). A retainer (30) in the form of a push-pull pin can be used to maintain the tensioning means (inside the platform) at a chosen level of tension.

Figure 2:
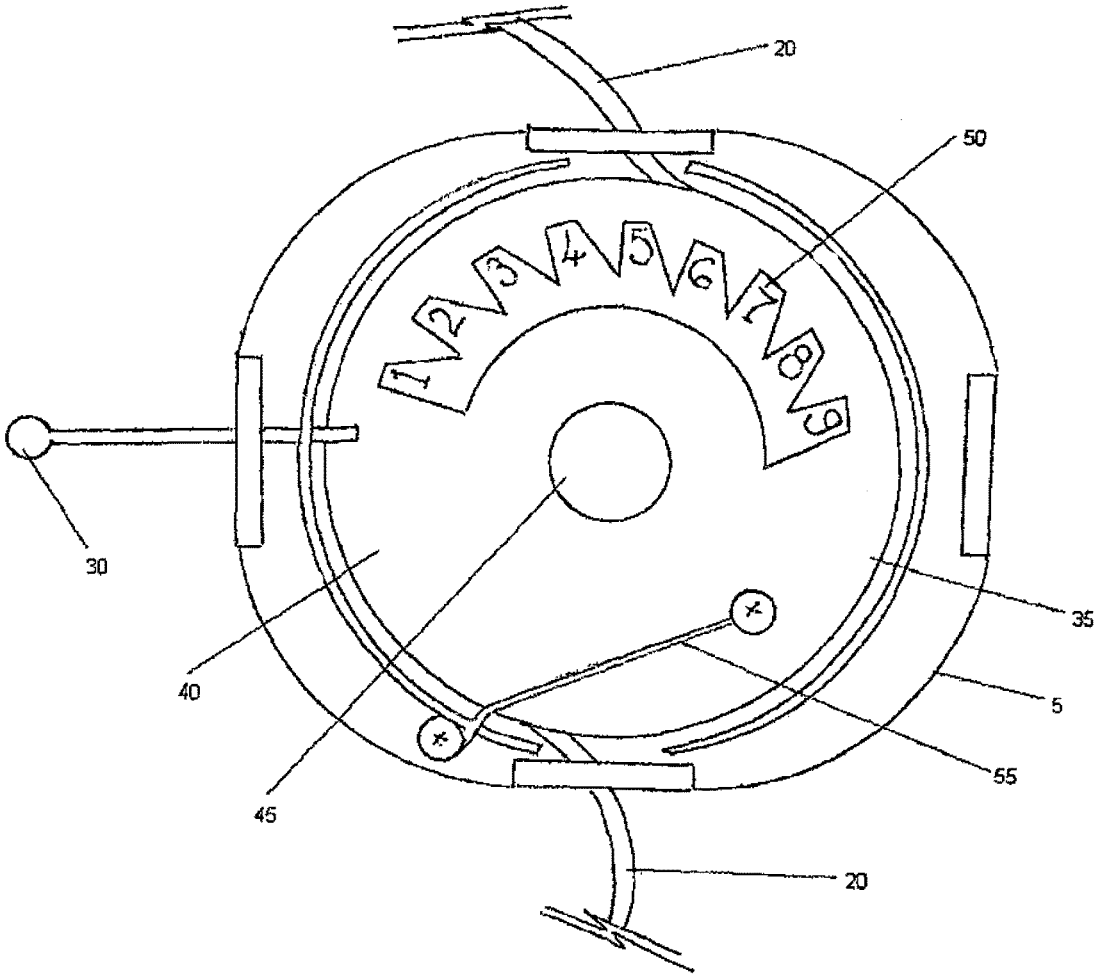
FIG. 2 illustrates the exercise device of FIG. 1 when inverted.

FIG. 2 illustrates the exercise device of FIG. 1 inverted to show the tensioning means (35) comprising a disk (40) and central hub (45) that can be manually rotated. A scale (50) marked from 1 to 9 can indicate the degree of rotation of the disk (40) and hub (45). The extendable cord (20) is connected to the hub (45) such that rotation of the disk (40) in an anti-clockwise direction reduces the length of cord (40) extending from the platform (5). Rotation in the clockwise direction increases the length of cord (40) extending from the platform (5). The extendable cord (40) is thus rolled and unrolled around the hub (45).

In this embodiment the tensioning means (35) is rotated against a biasing means (55) comprising an extendable band connected at one end to the disk (40) and at the other end to the platform (5).

Figure 3:
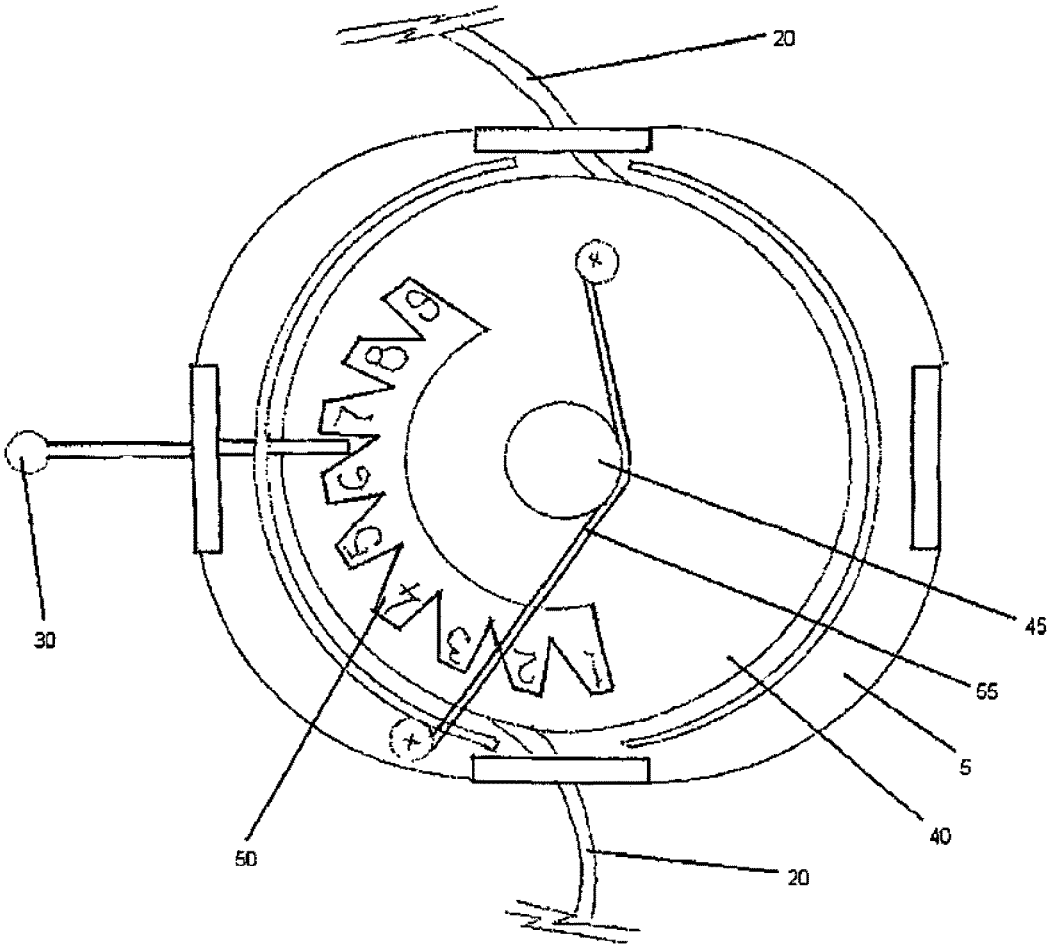
FIG. 3 illustrates the exercise device of FIG. 1 when inverted and with the tensioning device adjusted.

FIG. 3 illustrates the exercise device of FIG. 1 inverted and with the disk (40) of the tensioning means (35) rotated anti-clockwise (as compared to the view in FIG. 2). The retainer pin (30) is inserted such that it retains the scale (50) at the position marked '7' as shown in the indicator window (25) (as shown in FIG. 1). The scale (50) projects from the disk (40) so that when the pin (30) is in the position shown it resists movement of the disk (40). The biasing means (55) acts to urge the disk (40) in the clockwise direction, back towards the position in which it is shown in FIG. 2. The biasing means may be of any convenient material such as a stretchable band of material or a coil spring or the like.

FIG. 4 illustrates a further embodiment of an exercise device (41) of the present invention viewed from above. In this view can be seen the upper surface of the platform (45) and a first handle (50) and a second handle (55) attached to either end of an extendable cord (not shown in this view). The upper surface of the platform (45) has sufficient width and depth to receive both feet of a user. The part of the extendable cord (60) that cannot be seen is located within the platform (45). The platform (45) includes a window (65) that can display indicia such as numbers indicating the relative amount of tension a user is likely to experience when they pull on one or both of the handles (50,55). The underside or lower surface of the platform (45) can be attached to various accessories to enhance the user experience by providing flexibility and variety to exercise routines. For example, the lower surface may be adapted to removably receive legs, rockers or wheels. When legs are in place beneath each corner, the platform (45) is elevated from the floor and can be used for step-aerobic exercises. Alternatively, rockers in the form of curved sections can be attached at opposite ends of the platform (45) so that the user can perform balance exercises. In another alternative, the lower surface may rest on wheels, such as casters, to enable a horizontal rolling movement to be combined with pulling of the extendable cords (50, 55). In this embodiment, the tensioning mechanism used to adjust the tension on the extendable cord (60) comprises a foot pedal (68).

FIG. 5 illustrates the exercise device of FIG. 4 when inverted, with the lower surface removed to reveal the mechanism residing between the upper and lower surfaces of the platform (45), which are ordinarily held in contact by multiple screws.

The extendable cords (not shown) are each attached at one end to their respective handles (50,55), and at their other ends to the disk (80). The extendable cords are at least partly coiled around the disk (80), located within a groove or recess at the peripheral edge of the disk (80). A central hole in the disk (80) fits around a hub (85) that is integral with the upper surface of the platform (45). A large flat circular spring (82) is located between the disk (80) and the hub (85). A first tang at the end of the spring (82) is held at a fixed position by the hub (85) while a second tang at the other end of the spring (82) can removably engage with slots around the periphery of the disk (80). Applying pressure to the foot pedal (68) brings it into contact with the disk (8) pushing the disk away from the second end of the spring (82), disengaging it from the first slot and leaving the disk (80) free to be rotated to a position where the second end of the spring can re-engage with a second slot when pressure is removed from the foot pedal (68). While the disk (80) is free it can be rotated clockwise by pulling on the handles (50,55) to increase the length of extendable cord projecting from the platform (45). Alternatively, if no pulling force is exerted, a biasing means causes the disk (80) to rotate anti-clockwise, retracting the extendable cords into the platform. When the pressure is removed from the foot pedal (68) a pair of biasing means in the, form of compression (coil) springs act to return the foot pedal (68) to its normal position, out of contact with the disk (80). Thus the circular spring (82) imparts a biasing force on the disk (80) coiling or uncoiling the extendable cords about the disk (80). This coiling and the elasticity inherent in the extendable cords determines the amount of resistance a user is likely to experience when they exercise and pull on one or both of the, handles (50,55).

The upper face of the disk (80) can be marked with indicia (numerals) at appropriate intervals adjacent the periphery to reflect the amount of resistance a user experiences at different positions of the disk (80). A small window (65) in the upper surface of the platform (45) displays individual indicia.

While this invention has been described in connection with specific embodiments thereof, it will be understood that it is capable of further modification(s). This application is intended to cover any variations uses or adaptations of the invention following in general, the principles of the invention and including such departures from the present disclosure as come within known or customary practice within the art to which the invention pertains and as may be applied to the essential features hereinbefore set forth.

As the present invention may be embodied in several forms without departing from the spirit of the essential characteristics of the invention, it should be understood that the above described embodiments are not to limit the present invention unless otherwise specified, but rather should be construed broadly within the spirit and scope of the invention as defined in the appended claims. The described embodiments are to be considered in all respects as illustrative only and not restrictive.

Various modifications an equivalent arrangements are intended to be included within the spirit and scope of the invention and appended claims. Therefore, the specific embodiments are to be understood to be illustrative of the many ways in which the principles of the present invention may be practiced. In the following claims, means-plus-function clauses are intended to cover structures as performing the defined function and not only structural equivalents, but also equivalent structures.

"Comprises/comprising" and "includes/including" when used in this specification is taken to specify the presence of stated features, integers, steps or components but does not preclude the presence or addition of one or more other features, integers, steps, components or groups thereof. Thus, unless the context clearly requires otherwise, throughout the description and the claims, the words 'comprise', 'comprising', 'includes', 'including' and the like are to be construed in an inclusive sense as opposed to an exclusive or exhaustive sense; that is to say, in the sense of "including, but not limited to".

The claims defining the invention are as follows:

1. An exercise device comprising;

a platform, a first limb attachment means, a second limb attachment means, a first extendable cord attached to the first limb attachment means, the first extendable cord being at least partially located within the platform, a second extendable cord attached to the second limb attachment means, the second extendable cord being at least partially located within the platform, and a tensioning means within the platform, wherein the tensioning means comprises:

only one rotatable disk, disposed with a horizontal planar orientation when in use, to which the first extendable cord and second extendable cord are attached, the one rotatable disk being rotatable about a hub, and a retainer for maintaining the one rotatable disk in a chosen position to provide a predetermined resistance of the first extendable cord and second extendable cord to extension.

2. The exercise device according to claim 1 wherein the tensioning means further comprises a scale that indicates the degree of rotation of the one rotatable disk about the hub and corresponding resistance of the first extendable cord to extension.

3. The exercise device according to claim 1 wherein the retainer comprises a push-pull pin and the device further includes an actuator that can actuate movement of the push-pull pin into and out of contact with the one rotatable disk.

4. The exercise device according to claim 1 wherein the one rotatable disk and hub interconnect via a biasing means.

5. The exercise device according to claim 1 wherein the platform housing includes an actuator comprising a foot pedal.

6. The exercise device according to claim 1 which is adapted to removably receive legs, rockers or wheels for step-aerobic exercises, balance exercises or horizontal rolling exercises.

7. The exercise device according to claim 1 wherein the limb attachment means is adapted for attachment to hands, feet, legs, thighs, forearms or upper arms.

8. A method of exercising using the exercise device of claim 1, the method including the user carrying out the steps of:

(a) standing, sitting, kneeling or lying on the platform, (b) engaging the first limb attachment means with a limb, (c) applying pulling force through the limb attachment means to cause the first extendable cord to extend from the platform, then (d) releasing the pulling force applied through the limb attachment means to allow the first extendable cord to retract into the platform.

9. The method according to claim 8 which further includes manual adjustment of the device including the steps of;

(e) rotating the one rotatable disk about the hub, (f) applying the retainer to the one rotatable disk to maintain the one rotatable disk in a chosen position to provide a predetermined resistance of the first extendable cord to extension.

10. A method of exercising using the exercise device of claim 1, the method including the user carrying out the steps of adding legs, rockers or wheels to the platform for step-aerobic exercises, balance exercises or horizontal rolling exercises.

11. An exercise device comprising;

a platform, a first limb attachment structure, a second limb attachment structure, a first extendable cord attached to the first limb attachment structure, the first extendable cord being at least partially located within the platform, a second extendable cord attached to the second limb attachment structure, the second extendable cord being at least partially located within the platform, a tensioning mechanism within the platform, wherein the tensioning mechanism comprises:

only one rotatable disk, disposed with a horizontal planar orientation when in use, to which the first extendable cord and second extendable cord are attached, the disk being rotatable about a hub, and a retainer for maintaining the one rotatable disk in a chosen position to provide a predetermined resistance of the first extendable cord and second extendable cord to extension, and a biasing structure acting to return the one rotatable disk from a chosen position to an original position.

12. The exercise device according to claim 11 wherein the biasing structure comprises an extendable band connected at one end to the one rotatable disk and at another end to the platform.

* * * * *